US010486718B2

(12) United States Patent
Ozerdim et al.

(10) Patent No.: US 10,486,718 B2
(45) Date of Patent: Nov. 26, 2019

(54) HOPPER CAR GATE SEAL

(71) Applicant: Trinity North American Freight Car, Inc., Dallas, TX (US)

(72) Inventors: Caglar Ozerdim, Dallas, TX (US); Lee A. Reitz, Euless, TX (US); Aubra D. McKisic, Flower Mound, TX (US); George Creighton, Pompano Beach, FL (US)

(73) Assignee: TRINITY NORTH AMERICAN FREIGHT CAR, INC., Dallas, TX (US)

( * ) Notice: Subject to any disclaimer, the term of this patent is extended or adjusted under 35 U.S.C. 154(b) by 326 days.

(21) Appl. No.: 15/462,089

(22) Filed: Mar. 17, 2017

(65) Prior Publication Data

US 2017/0267259 A1 Sep. 21, 2017

Related U.S. Application Data

(60) Provisional application No. 62/310,265, filed on Mar. 18, 2016.

(51) Int. Cl.
*B61D 7/02* (2006.01)
*E06B 7/22* (2006.01)
(Continued)

(52) U.S. Cl.
CPC ..... *B61D 7/02* (2013.01); *B61D 7/18* (2013.01); *B61D 7/22* (2013.01); *B61D 7/24* (2013.01); *E06B 7/22* (2013.01)

(58) Field of Classification Search
CPC ... B61D 7/02; B61D 7/18; B61D 7/22; B61D 7/24; B61D 17/16; B61D 39/008; B61D 7/16; E06B 7/22; B65D 90/623
See application file for complete search history.

(56) References Cited

U.S. PATENT DOCUMENTS 1,813,548 A * 7/1931 Small ..... B61D 7/18 105/280
3,401,645 A * 9/1968 Floehr ..... B61D 7/22 105/253

(Continued)

FOREIGN PATENT DOCUMENTS

WO 9962751 A1 12/1999
WO 2005021349 A1 3/2005

OTHER PUBLICATIONS

International Preliminary Report on Patentability for PCT Patent Application No. PCT/US2017/023009, dated Sep. 27, 2018; 7 pages.

(Continued)

*Primary Examiner* — Mark T Le
(74) *Attorney, Agent, or Firm* — Baker Botts, LLP

(57) ABSTRACT

According to some embodiments, a railcar comprises a hopper with a sloped sheet and a discharge door. A first end of the discharge door is coupled to the railcar and pivots the discharge door between closed and open positions. The sloped sheet comprises a discharge end that is in contact with the discharge door when in the closed position. A second end of the discharge door extends beyond the discharge end of the sloped sheet when in the closed position. The discharge door comprises a lip disposed at its second end that extends generally perpendicular to the discharge door and parallel to the sloped sheet when the discharge door is in the closed position. The sloped sheet comprises a gasket coupled to its exterior portion. The lip of the discharge door contacts the gasket when in the closed position.

20 Claims, 13 Drawing Sheets

(51) Int. Cl.

| | |
|---|---|
| ***B61D 7/18*** | (2006.01) |
| ***B61D 7/22*** | (2006.01) |
| ***B61D 7/24*** | (2006.01) |

(56) References Cited

U.S. PATENT DOCUMENTS

| | | | | |
|---|---|---|---|---|
| 4,138,948 | A | 2/1979 | Korolis | |
| 4,222,333 | A | 9/1980 | Schuller | |
| 6,164,210 | A * | 12/2000 | Coslovi | B61D 7/00 105/396 |
| 6,227,124 | B1 * | 5/2001 | Gaydos | B61D 7/26 105/286 |
| 2002/0100390 | A1 * | 8/2002 | Jwuc | B61D 7/00 105/247 |
| 2006/0288903 | A1 * | 12/2006 | Bush | B61D 7/00 105/358 |
| 2007/0084378 | A1 | 4/2007 | Creighton et al. | |

OTHER PUBLICATIONS

International Search Report and Written Opinion received for PCT Patent Application No. PCT/US2017/023009, dated Jun. 30, 2017; 12 pages.

* cited by examiner

HOPPER CAR GATE SEAL

RELATED APPLICATIONS

This application claims priority to U.S. Provisional Application Ser. No. 62/310,265 entitled "HOPPER CAR WITH LONGITUDINAL DOORS," filed Mar. 18, 2016.

TECHNICAL FIELD

Particular embodiments relate generally to railcars and more particularly to hopper cars for carrying bulk materials such as grains and any other lading suitable for transportation in hopper cars.

BACKGROUND

Railway hopper cars transport and sometimes store bulk materials. Hopper cars generally include one or more hoppers which may hold cargo or lading during shipment. Hopper cars are frequently used to transport coal, sand, metal ores, aggregates, grain and any other type of lading which may be satisfactorily discharged through openings formed in one or more hoppers. Discharge openings are typically provided at or near the bottom of each hopper to rapidly discharge cargo. A variety of door assemblies or gate assemblies along with various operating mechanisms have been used to open and close discharge openings associated with railway hopper cars.

Transversely oriented discharge openings and gates are frequently coupled with a common linkage operated by an air cylinder. The air cylinder is typically mounted in the same orientation as the operating gate linkage which is often a longitudinal direction relative to the associated hopper. Transverse gates are frequently opened and closed by separate operating assemblies that cause synchronization problems and require adjustments. Furthermore, a rail yard employee may need access underneath a hopper car when operating a transverse gate.

Longitudinally oriented discharge openings and associated doors may provide a quicker discharge than transverse gates. Longitudinally oriented discharge openings and doors are often used in pairs that may be rotated or pivoted relative to the center sill or side sills of a hopper car. Longitudinally oriented discharge openings and doors may be coupled with a beam operated by an air cylinder. The air cylinder is typically mounted in the same orientation as the operating beam which is often a longitudinal direction relative to the associated hopper. The operating beam may be coupled to the discharge doors by door struts that push (or pull) the gates open or pull (or push) them closed as the air cylinder moves the operating beam back and forth.

Hopper cars may be classified as open or closed. Hopper cars may have relatively short sidewalls and end walls or relatively tall or high sidewalls and end walls. The sidewalls and end walls of many hopper cars are often formed from steel or aluminum sheets and reinforced with a plurality of vertical side stakes or support posts. Some hopper cars include interior frame structures or braces to provide additional support for the sidewalls.

Applicable standards of the Association of American Railroads (AAR) established maximum total weight on rail for any railcar including boxcars, freight cars, hopper cars, gondola cars, tank cars and temperature controlled railway cars within prescribed limits of length, width, height, etc. All railcars operating on commercial rail lines in the U.S. must have exterior dimensions which satisfy associated AAR clearance plates. Therefore, the maximum load which may be carried by any railcar is typically limited by AAR standards for total weight on rail, applicable AAR clearance plate and empty weight of the railcar. Reducing the empty weight of a railcar or increasing interior dimensions may increase both volumetric capacity and maximum load capacity of a railcar while still meeting applicable AAR standards for total weight on rail and AAR clearance plate.

SUMMARY

According to some embodiments, a railcar comprises an underframe, a pair of sidewall assemblies, and at least one hopper formed between the sidewall assemblies. The hopper comprises a sloped sheet and a discharge door. The discharge door comprises a first end and a second end opposite the first end. The first end of the discharge door is pivotally coupled to the railcar and operable to pivot the discharge door between a closed position that restricts a discharge of lading from the at least one hopper and an open position that facilitates the discharge of lading from the at least one hopper. The sloped sheet comprises a discharge end. The discharge end is in contact with the discharge door when the discharge door is in the closed position. The sloped sheet comprises a gasket coupled to an exterior portion of the sloped sheet. The second end of the discharge door extends beyond the discharge end of the sloped sheet when the discharge door is in the closed position. The discharge door further comprises a lip disposed at the second end of the discharge door extending generally perpendicular to the discharge door and parallel to the sloped sheet when the discharge door is in the closed position. The lip of the discharge door contacts the gasket of the sloped sheet when the discharge door is in the closed position. The lip of the discharge door may comprise a formed arcuate shape.

In particular embodiments, the gasket coupled to the sloped sheet is set back from the discharge end of the sloped sheet so that the gasket is out of a discharge path of the lading during the discharge of the lading from the at least one hopper. The gasket may be removably coupled to the sloped sheet.

In particular embodiments, a portion of the discharge door facing the interior of the hopper is lined with a first material and the lip of the discharge door comprises a second material different from the first material. An interior portion of the sloped sheet may be lined with a first material and the discharge end of the sloped sheet may be lined with a second material different from the first material. The lip of the discharge door may comprise stainless steel. The discharge door may comprise a longitudinal discharge door or a transverse discharge door.

According to some embodiments, a discharge apparatus for a railcar hopper comprises a gasket coupled to an exterior portion of a sloped sheet of the railcar hopper and a discharge door. The discharge door comprises a first end and a second end. The first end of the discharge door is operable to pivot the discharge door between a closed position that restricts a discharge of lading from the railcar hopper and an open position that facilitates the discharge of lading from the railcar hopper. The discharge door comprises a lip disposed at the second end of the discharge door extending generally perpendicular to the discharge door and parallel to the sloped sheet when the discharge door is in the closed position. The second end of the discharge door extends beyond a discharge end of the sloped sheet when the discharge door is in the closed position, and the lip of the discharge door contacts the gasket coupled to the exterior portion of the sloped sheet when the discharge door is in the closed position.

In particular embodiments, the gasket coupled to the exterior portion of the sloped sheet is set back from the discharge end of the sloped sheet so that the gasket is out of a discharge path of the lading during the discharge of the lading from the at least one hopper. The gasket may be removably coupled to the sloped sheet.

In particular embodiments, a portion of the discharge door facing the interior of the at least one hopper is lined with a first material and the lip comprises a second material different from the first material. An interior portion of the sloped sheet may be lined with a first material and the discharge end of the sloped sheet may be lined with a second material different from the first material. The lip of the discharge door may comprise stainless steel. The discharge door may comprise a longitudinal discharge door or a transverse discharge door.

According to some embodiments, a method of outfitting a railcar hopper with a discharge gate seal comprises coupling a gasket to an exterior portion of a sloped sheet of the railcar hopper, and coupling a lip extension to a discharge door of the railcar hopper. The lip extension extends beyond a discharge end of the sloped sheet when the discharge door is in the closed position. The lip of the lip extension extends generally perpendicular to the discharge door and parallel to the sloped sheet when the discharge door is in the closed position. The lip of the lip extension contacts the gasket coupled to the exterior portion of the sloped sheet when the discharge door is in the closed position. The discharge door may comprise a longitudinal discharge door or a transverse discharge door.

In particular embodiments, the method further comprises uncoupling the gasket from the exterior portion of the sloped sheet, and coupling a replacement gasket to the exterior portion of the sloped sheet.

As a result, particular embodiments of the present disclosure may provide numerous technical advantages. For example, some lading materials, such as fine grain materials, tend to leak from a conventional hopper car even when the discharge doors are closed. Particular embodiments provide a seal to reduce or prevent leakage.

Furthermore, in rainy or otherwise wet conditions, conventional hopper cars tend to allow water seepage into the lading from the discharge door edges. The seepage can contaminate the lading and lead to corrosion of the components of the hopper near the discharge door edges. In particular embodiments, the seal also restricts or prevents water seepage. The seal is configured such that the lading does not contact or flow over the seal material during discharge, protecting the seal from wear or other damage. Preventing loss and contamination provides economic advantages.

Depending on the intended type of commodity for transport, hopper cars may include an interior lining. In conventional hopper cars the interior lining is prone to chipping at the interface between the discharge door and its opening. Particular embodiments provide a strengthened lining at the intersection of a discharge door and its opening. In some embodiments, the lining may provide corrosion resistance. Particular embodiments of the present disclosure may provide some, none, all, or additional technical advantages.

BRIEF DESCRIPTION OF THE DRAWINGS

For a more complete understanding of the particular embodiments, and the advantages thereof, reference is now made to the following written description taken in conjunction with the accompanying drawings, in which.

DETAILED DESCRIPTION

Figure 1:
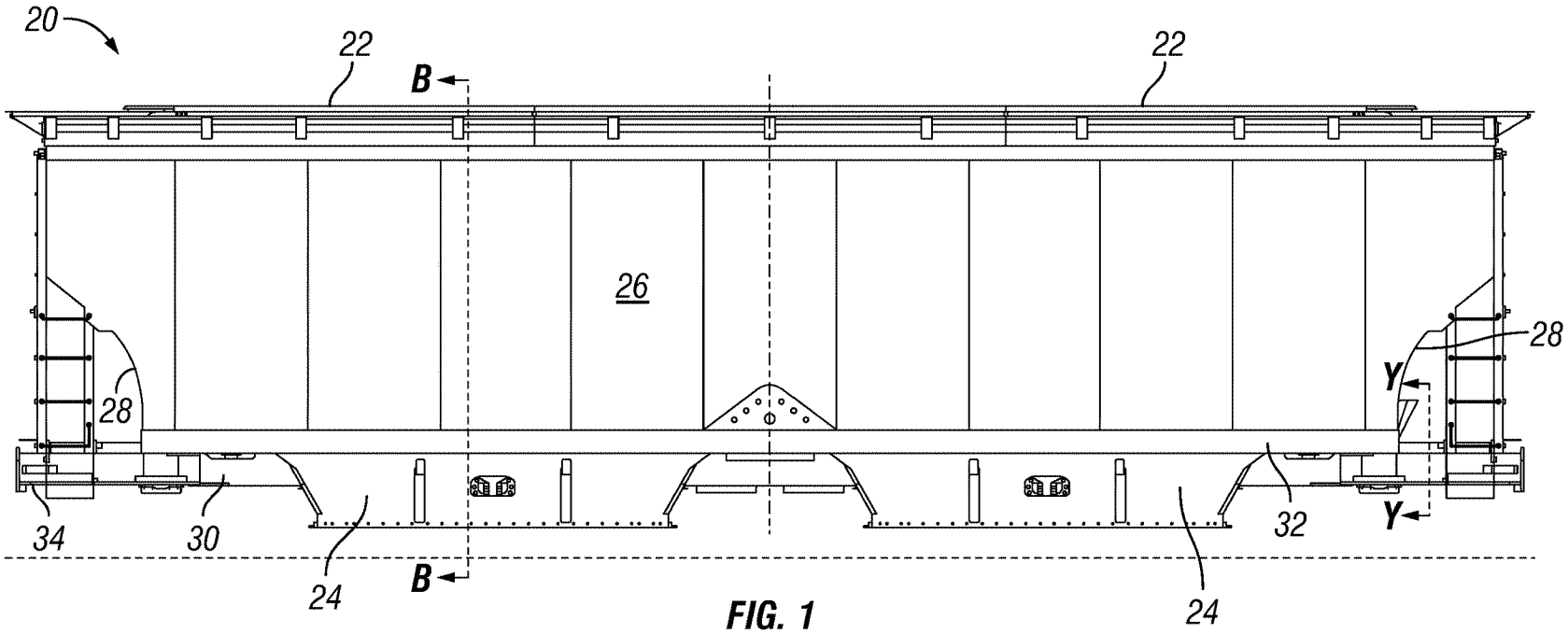
FIG. 1 is a schematic drawing in elevation showing a side view of an example hopper car, according to a particular embodiment.

An object of the present disclosure is to obviate disadvantages and problems associated with hopper cars. For example, as fast-unloading longitudinal door systems gain in popularity for transporting varied commodities, the discharge flow rate of the lading may exceed the capacity of the takeaway system. Particular embodiments provide an adjustment mechanism to meter the flow rate to match the capacity of the takeaway system. Controlling the flow rate results in a more efficient unloading process, thus providing cost savings.

As another example, some lading materials, such as fine grain materials, tend to leak from a conventional hopper car even when the discharge doors are closed. Particular embodiments provide a seal to reduce or prevent leakage.

Furthermore, in rainy or otherwise wet conditions, conventional hopper cars tend to allow water seepage into the lading from the discharge door edges. The seepage can contaminate the lading and lead to corrosion of the components of the hopper near the discharge door edges. In particular embodiments, the seal also restricts or prevents water seepage. The seal is configured such that the lading does not contact or flow over the seal material during discharge, protecting the seal from wear or other damage. Preventing loss and contamination provides economic advantages.

Depending on the intended type of commodity for transport, hopper cars may include an interior lining. In conventional hopper cars the interior lining is prone to chipping at the interface between the discharge door and its opening. Particular embodiments provide a strengthened lining at the intersection of a discharge door and its opening. In some embodiments, the lining may provide corrosion resistance.

Particular embodiments include an operating beam for the discharge doors that is simpler and more cost effective to manufacture. In particular embodiments, the operating beam may be extruded or pultruded, instead of the conventional method of attaching lugs and gussets to a rectangular beam. Additionally, the operating beam provides for simpler attachment of the door struts. In particular embodiments, the door struts are coupled to the operating beam with a pin and bushings. The bushings may reduce or prevent wear and galling.

With any rail car that transports light weight commodities, the car is likely to exceed its maximum carrying volume before it exceeds its maximum allowed car gross rail load. Particular embodiments provide a hopper car with increased carrying volume while also complying with AAR size and weight specifications. Some embodiments increase the radius of the curvature of the sides of the hopper car. Increased carrying volume facilitates shipping of more commodity which increases profit per shipment.

Metal fatigue caused by any additional flexing of the larger radius sides may be prevented with reinforcement plates at particular locations and interior stiffeners. Reducing metal fatigue may result in lower repair costs. Particular embodiments lower the side sill so that it is adjacent to the shear plate.

Particular embodiments are described with reference to FIGS. 1-18 of the drawings. Like numbers may be used for like and corresponding parts of the various drawings. Various features of the embodiments will be described with respect to hopper car 20 as shown in FIGS. 1-18.

FIG. 1 is a schematic drawing in elevation showing a side view of an example hopper car, according to a particular embodiment. Hopper car 20 may carry bulk materials such as coal and other types of lading. Examples of such lading may include sand, metal ores, aggregate, grain, ballast, etc.

Hopper car 20 may be generally described as a covered hopper car. However, other embodiments may include open hopper cars or any other cars suitable for carrying bulk lading. Hopper car 20 includes hoppers 22 with bottom discharge assemblies 24. Discharge assemblies 24 may be opened and closed to control discharge of lading from hoppers 22. As illustrated, hopper car 20 includes two hoppers 22. In other embodiments, hopper car 20 may include one, two, three, or any suitable number of hoppers 22.

In particular embodiments, hopper 22 is configured to carry bulk materials and the interior walls of hopper 22 are generally sloped towards discharge assembly 24 to facilitate discharge of the lading. Multiple hoppers 22 may be separated by interior bulkheads.

In particular embodiments, hopper car 20 may include a pair of sidewall assemblies 26 and sloped end wall assemblies 28 mounted on a railway car underframe. The railway car underframe includes center sill 34 and a pair of shear plates 32. A pair of sill plates 32 provide support for sidewall assemblies 26.

Center sill 34 is a structural element for carrying the loads of the hopper car. Center sill 34 transfers the various longitudinal forces encountered during train operation from car to car. Shear plates 30 extend generally parallel with center sill 34 and are spaced laterally from opposite sides of center sill 34.

Figure 2:
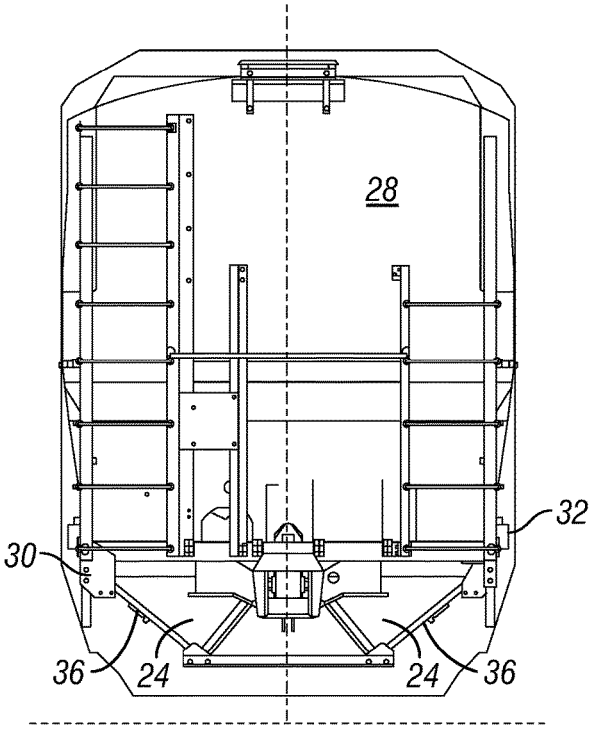
FIG. 2 is a schematic drawing in elevation showing an end view of an example hopper car, according to a particular embodiment.

FIG. 2 is a schematic drawing in elevation showing an end view of an example hopper car, according to a particular embodiment. FIG. 2 illustrates discharge assemblies 24, end wall assemblies 28, shear plates 30, and sill plates 32 of hopper car 20 illustrated in FIG. 1.

Discharge assembly 24 comprises slope sheet 36. Slope sheet 36 slopes from sidewall assembly 26 towards the center of hopper car 20 to facilitate discharge of the lading from the discharge opening of discharge assembly 24.

Figure 3:
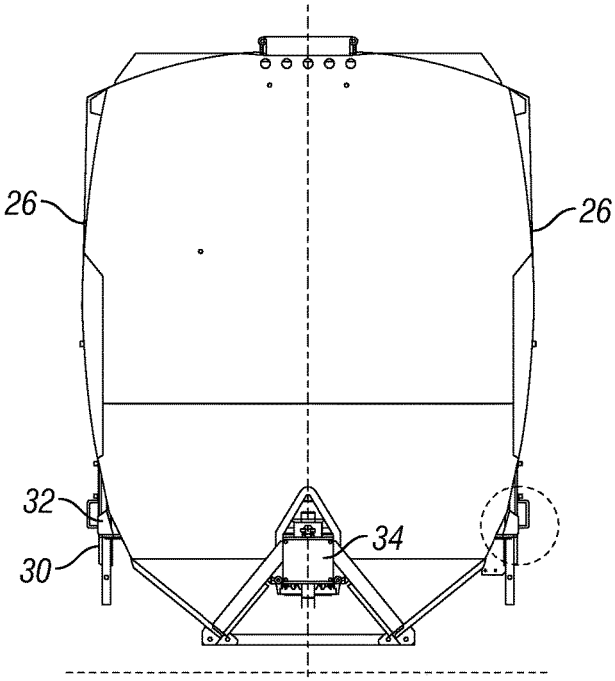
FIG. 3 is a schematic drawing showing a cross section view of an example hopper car taken along lines B-B of FIG. 1.

FIG. 3 is a schematic drawing showing a cross section view of an example hopper car taken along lines B-B of FIG. 1. FIG. 3 illustrates side wall assemblies 26, shear plates 30, sill plates 32, and center sill 34 of hopper car 20 illustrated in FIG. 1.

Figure 4:
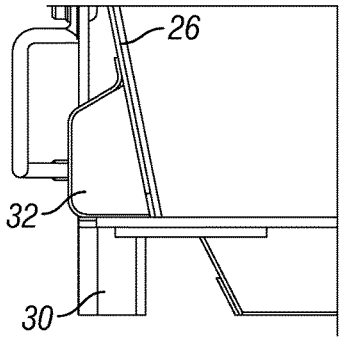
FIG. 4 is a schematic drawing showing a cross sectional view of a sill plate of an example hopper car taken along lines Y-Y of FIG. 1.

Side wall assemblies 26 may be curved as illustrated in FIGS. 2-4. Sidewall assemblies of conventional hopper cars may form a curvature with a radius of approximately fifteen feet. To increase the volume of hopper car 20, the curvature of side wall assemblies 26 may comprise a radius of approximately twenty feet. In other embodiments, the curvature of side wall assemblies 26 may comprise a radius of any suitable length greater than fifteen feet.

To achieve a sidewall assembly curvature with a radius of approximately twenty feet, particular embodiments may lower side sills 32 proximate to shear plates 30. Conventional hopper cars, particularly hopper cars with transverse discharge gates, provide access underneath the hopper car for rail yard personnel. For example, rail yard personnel may access the underside of the hopper car to manually open and close transverse gates. To provide sufficient clearance to access the underside of the hopper car, the side sill was located a suitable distance above the shear plate.

An advantage of hopper car 20 with longitudinal discharge gates is that less clearance is needed underneath hopper car 20. For example, discharge assembly 24 may comprise a touchpad operated longitudinal discharge assembly. Because particular embodiments obviate the need to access the underside of hopper car 20, sill plates 32 may be lowered proximate to shear plates 30 and the radius of sidewall assemblies 26 may be increased to approximately twenty feet. An increased radius increases the interior volume of hopper car 20 and thus increases the carrying capacity of hopper car 20.

FIG. 4 is a schematic drawing showing a cross sectional view of a sill plate of an example hopper car taken along lines Y-Y of FIG. 1. FIG. 4 illustrates a close up view of side wall assembly 26, shear plate 30, and sill plate 32 of hopper car 20 illustrated in FIGS. 1-3.

As illustrated, sill plate 32 is located proximate to shear plate 32 and provides support for side wall assembly 26. The particular shape of sill plate 32 illustrated in FIG. 4 provides support for side wall assembly 26. Other embodiments may vary the geometry of sill plate 32 to provide support for various sidewall assemblies 26.

Increasing the curvature of sidewall assemblies 26 may increase the flexing of hopper car 20 when in motion and when loading and unloading the lading. Particular embodiments may include a reinforcement plate, such as the doubler plate illustrated in FIG. 5, to reduce flexing.

Figure 5:
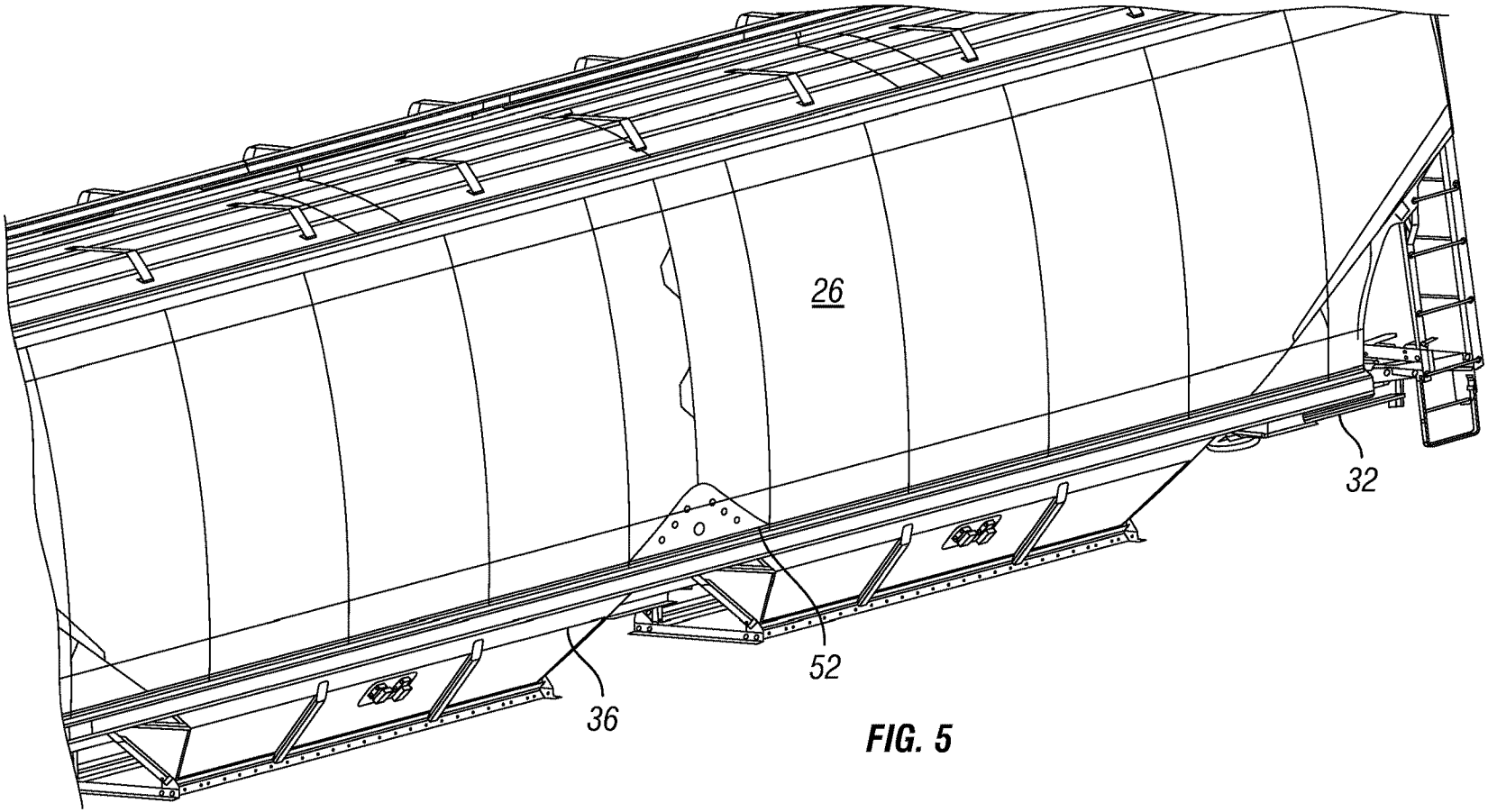
FIG. 5 is a perspective drawing showing an elevation of an example hopper car with a doubler plate between hoppers and a side sill adjacent to a shear plate of the hopper car, according to a particular embodiment.

FIG. 5 is a perspective drawing showing an elevation of an example hopper car with a doubler plate between hoppers and a side sill adjacent to a shear plate of the hopper car, according to a particular embodiment. Doubler plate 52 provides reinforcement to the intersection of the interior bulkhead (not illustrated), slope sheets 36, and sidewall assembly 26. The particular shape of doubler plate 52 illustrated in FIG. 5 reduces flexing of hopper car 20. Other embodiments may vary the geometry of doubler plate 52 to prevent flexing for various hopper cars 20. Reduced flexing reduces metal fatigue which increases the useful life, and time between repairs, of hopper car 20.

In particular embodiments, sidewall assembly 26 includes interior stiffeners to reduce flexing. Particular embodiments may comprise any suitable combination of doubler plate 52 and interior stiffeners.

Particular embodiments improve the manufacturability and performance of longitudinal discharge assemblies 24. For example, particular embodiments include metering the discharge flow rate of the lading material, improved sealing of the discharge doors, and improved interior lining near the discharge doors. Particular embodiments include an operating beam that is simple and cost effective to manufacture and assemble.

Figure 6:
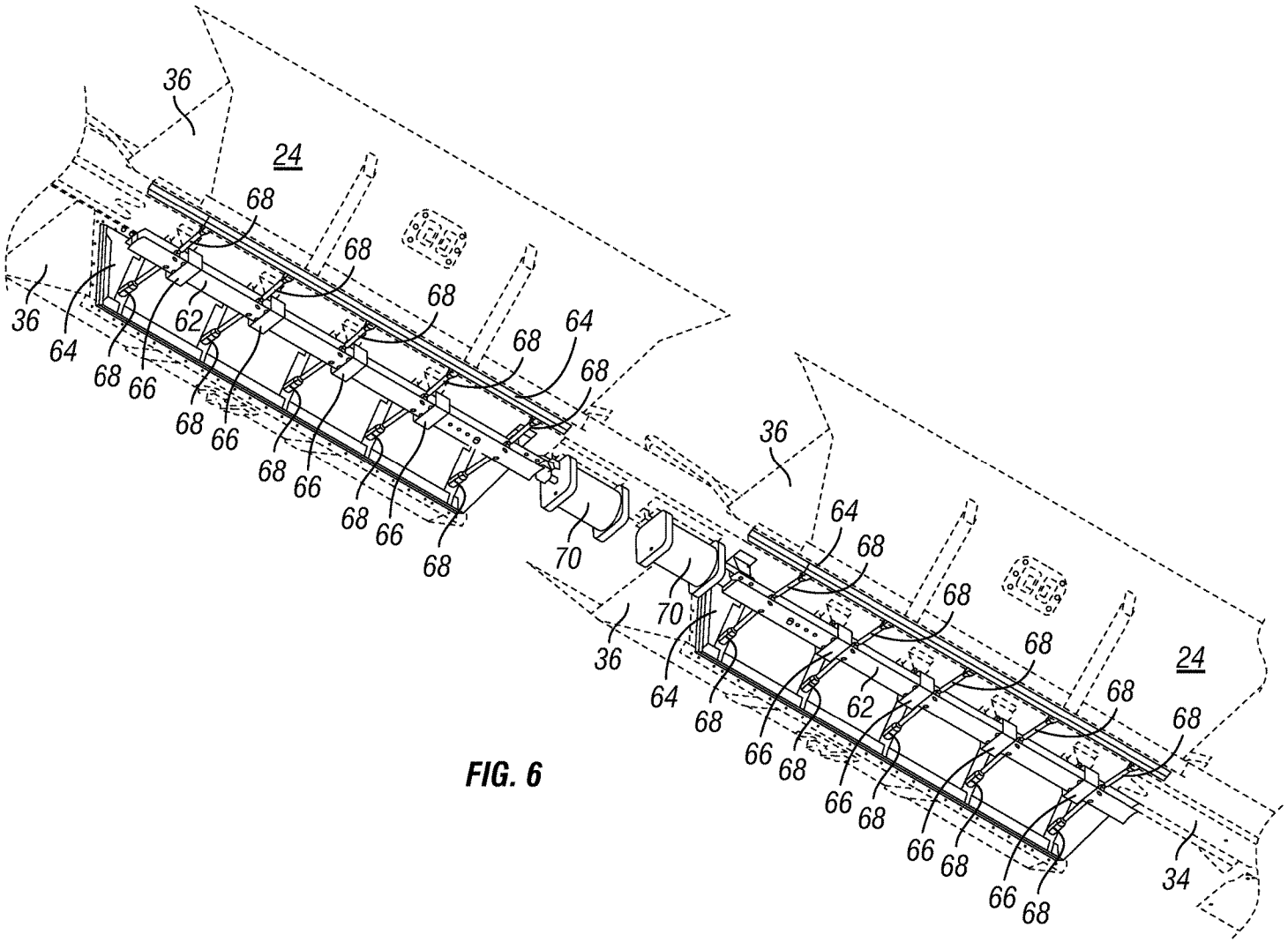
FIG. 6 is a schematic perspective drawing illustrating longitudinal discharge doors underneath an example hopper car, according to a particular embodiment.

FIG. 6 is a schematic perspective drawing illustrating longitudinal discharge doors underneath an example hopper car, according to a particular embodiment. FIG. 6 illustrates in more detail the two discharge assemblies 24 illustrated in FIG. 1. Discharge assembly 24 includes operating beam 62, discharge doors 64, guides 66, door struts 68, and operating cylinder 70.

Operating beam 62 is coupled to center sill 34 by guides 66. Operating beam 62 is coupled to discharge door 64 by door struts 68. Operating cylinder 70 is coupled to operating beam 62 and is operable to move operating beam 62 back and forth through guides 66.

Portions of slope sheet 36 cooperate with adjacent portions of center sill 34 to define longitudinal discharge openings. Longitudinal discharge openings are disposed along opposite sides of center sill 34.

Discharge doors 64 are hinged proximate to center sill 34. Various types of mechanical hinges may engage discharge doors 64 with center sill 34.

Discharge doors 64 are illustrated in the closed position, which prevents the discharge of lading through the longitudinal discharge openings. In operation, operating cylinder 70 moves operating beam 62 through guides 66 to open discharge doors 64 via door struts 68.

At a first end, door struts 68 are rotationally coupled to operating beam 62. At a second end, door struts 68 are rotationally coupled to discharge door 64. In particular embodiments, rotational coupling may be achieved via ball joints.

Operating cylinder 70 is operable to move operating beam 62 back and forth through guides 66. In particular embodiments operating cylinder 70 may comprise a pneumatic cylinder, or any type of motor suitable for moving operating beam 62 in a longitudinal direction.

Figure 10:
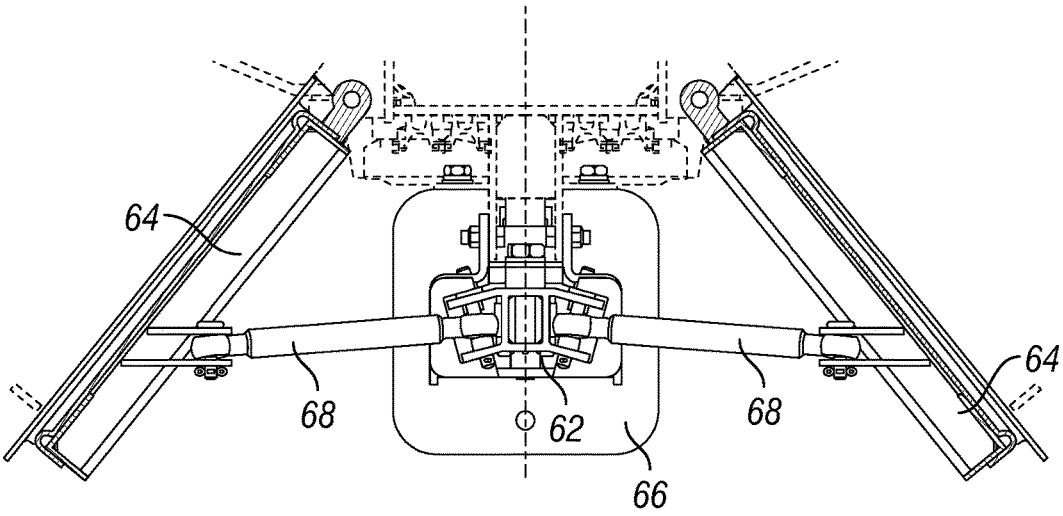
FIG. 10 is a schematic drawing showing a cross sectional view of closed longitudinal discharge doors of an example hopper car taken along lines B-B of FIG. 7.

Longitudinal movement of operating beam 62 results in radial extension of door struts 68 to move discharge doors 64 from their open position (see FIG. 11) to their closed position (see FIG. 10). Movement of operating beam 62 in the opposite direction results in pulling, pushing, or moving discharge doors from their closed position to their open position which allows rapid discharge of any lading contained within railway hopper car 20.

In particular embodiments, each hopper 24 of hopper car 20 may be operated independently of each other. In other embodiments, each hopper 24 may be operated in unison by a single operating cylinder 70 and operating beam 62.

Figure 7:
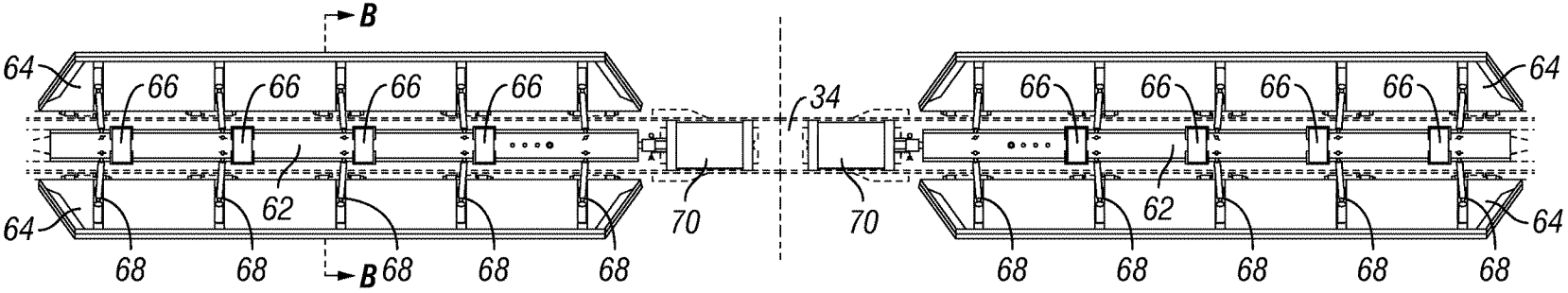
FIG. 7 is a schematic drawing illustrating longitudinal discharge doors and operating beam as viewed from underneath an example hopper car, according to a particular embodiment.

FIG. 7 is a schematic drawing illustrating longitudinal discharge doors and operating beam as viewed from underneath an example hopper car, according to a particular embodiment. FIG. 7 illustrates a different view of operating beam 62, discharge doors 64, guides 66, door struts 68, and operating cylinder 70 illustrated in FIG. 6.

Figure 8:
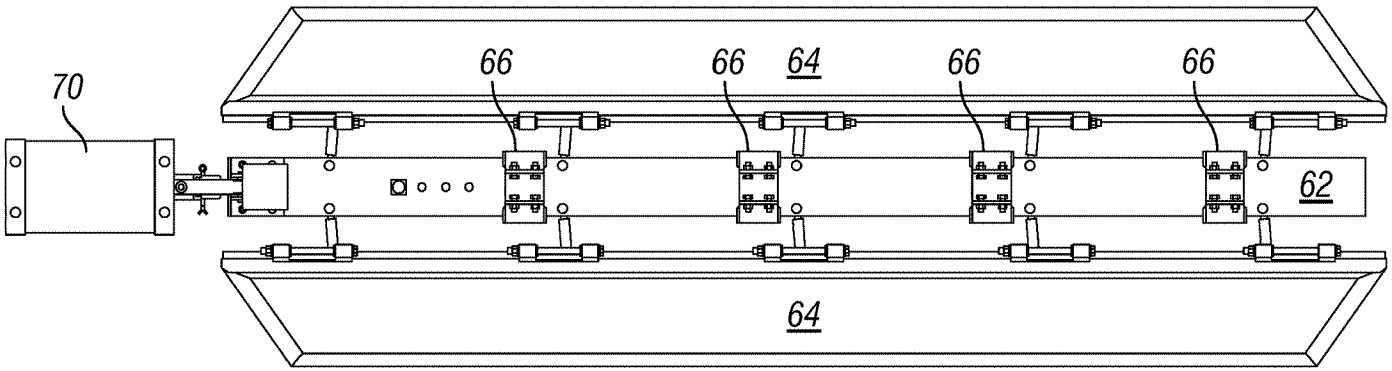
FIG. 8 is a schematic drawing in section illustrating longitudinal discharge doors and operating beam as viewed from above the longitudinal discharge doors of an example hopper car, according to a particular embodiment.

FIG. 8 is a schematic drawing in section illustrating longitudinal discharge doors and operating beam as viewed from above the longitudinal discharge doors of an example hopper car, according to a particular embodiment. FIG. 8 illustrates a different view of operating beam 62, discharge doors 64, guides 66, and operating cylinder 70 illustrated in FIG. 6.

Figure 9:
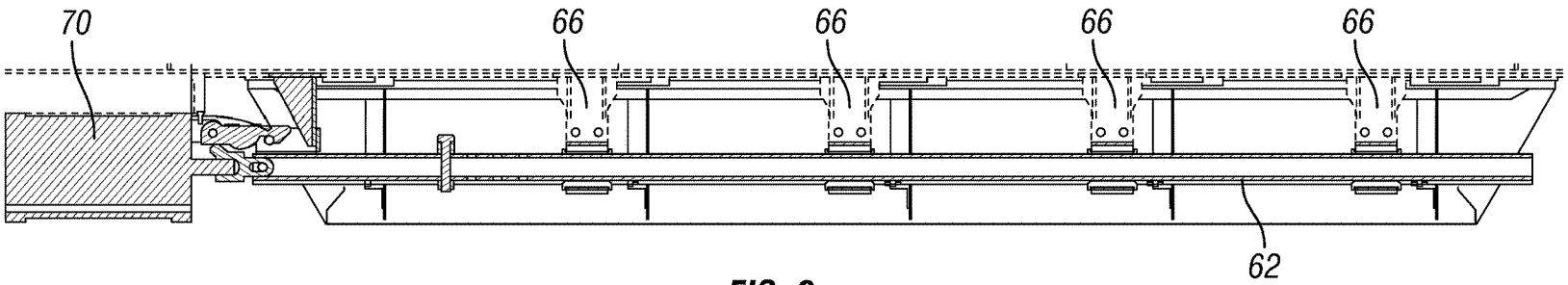
FIG. 9 is a schematic drawing illustrating a cross sectional view of longitudinal discharge doors and operating beam of an example hopper car taken along lines D-D of FIG. 7.

FIG. 9 is a schematic drawing illustrating a cross sectional view of longitudinal discharge doors and operating beam of an example hopper car taken along lines D-D of FIG. 7. FIG. 9 illustrates operating beam 62, guides 66, and operating cylinder 70. Guides 66 are coupled to center sill 34 and provide support for operating beam 62. Operating beam 62 is slidably coupled to guides 66 so that operating beam 62 may slide longitudinally through guides 66. Particular embodiments may include any suitable number of guides 66 to support operating beam 62.

Although the illustrated embodiments include four guides 66, other embodiments may vary the number of guides 66 based on the dimensions of hopper 22 or the dimensions or materials comprising operating beam 62. Guides 66 and door struts 68 are disposed in relation to each other such that door struts 68 guide 66 do not interfere with each other during operation.

FIG. 10 is a schematic drawing showing a cross sectional view of closed longitudinal discharge doors of an example hopper car taken along lines B-B of FIG. 7. In the illustrated embodiment, operating beam 62 is positioned such that door struts 68 apply pressure to discharge doors 64 holding them against slope sheets 36 of discharge assembly 24 to close the longitudinal discharge opening. In particular embodiments, operating cylinder 70 may be configured to apply more or less pressure to discharge doors 64.

Figure 11:
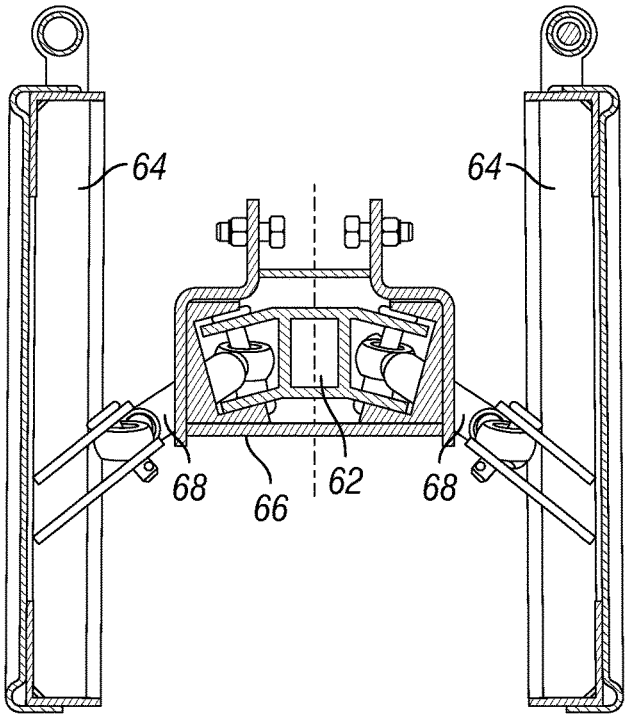
FIG. 11 is a schematic drawing showing a cross sectional view of open longitudinal discharge doors of an example hopper car, according to a particular embodiment.

FIG. 11 is a schematic drawing showing a cross sectional view of open longitudinal discharge doors of an example hopper car, according to a particular embodiment. In the illustrated embodiment, operating beam 62 is positioned such that door struts 68 push, pull, or move discharge doors 64 away from slope sheets 36 of discharge assembly 24 to open the longitudinal discharge opening.

Figure 12:
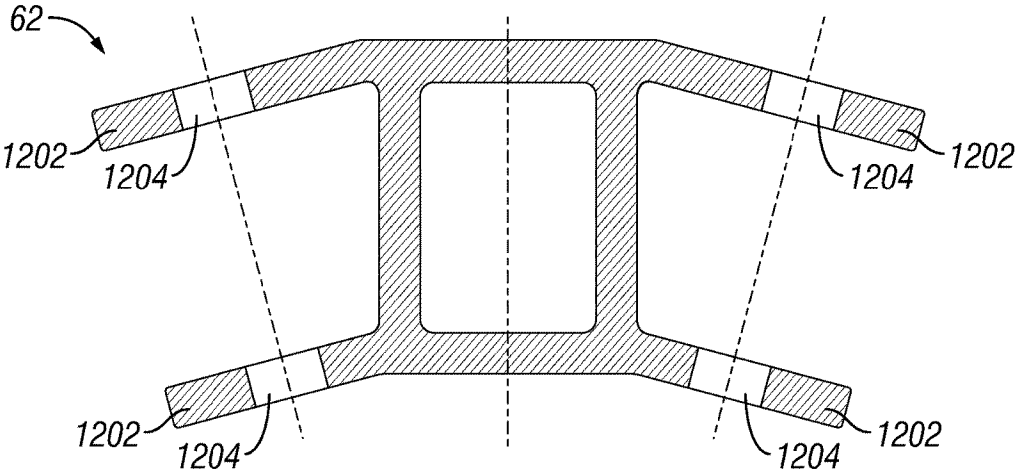
FIG. 12 is a schematic drawing showing a cross sectional view of an operating beam of an example hopper car, according to a particular embodiment.

FIG. 12 is a schematic drawing showing a cross sectional view of an operating beam of an example hopper car, according to a particular embodiment. Operating beam 62 includes angled flanges 1202 and strut mounting holes 1204.

In conventional hopper cars, an operating beam assembly may comprise a steel box beam. Mounting flanges for door struts may be coupled to the steel box beam with a combination of lugs, gussets or welds. Manufacturing a conventional operating beam assembly involves several steps to attach the flanges, lugs, gussets, or welds. Each attachment point of such a conventional fabrication is a potential failure point.

An advantage of operating beam 62 is that it may be extruded from aluminum, for example. In other embodiments, operating beam 62 may comprise extruded steel, or be pultruded as a fiber reinforced composite, such as a fiber or carbon composite. Strut mounting holes 1204 may simply be drilled into angled flanges 1202 at any desired location, without the need for a multitude of lugs, gussets, or welds.

Another advantage of operating beam 62 is that angled flanges 1202 are angled to accommodate the radial motion of door struts 68 as operating beam 62 moves back and forth and discharge doors 64 swing up and down. In particular embodiments the angle of angled flanges 1202 reduces stress on components of operating beam 62, door struts 68, and discharge doors 64.

Thus, operating beam 62 is simpler and more cost effective to manufacture than a conventional operating beam assembly. Additionally, operating beam 62 comprises fewer potential failure points.

Figure 13:
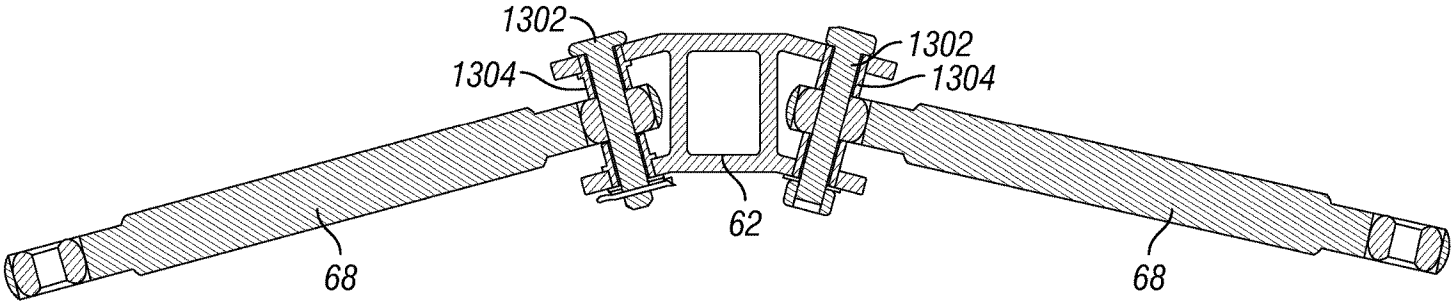
FIG. 13 is a schematic drawing showing a cross sectional view of an operating beam and door struts of an example hopper car, according to a particular embodiment.

FIG. 13 is a schematic drawing showing a cross sectional view of an operating beam and door struts of an example hopper car, according to a particular embodiment. Door struts 68 are rotationally coupled to operating beam 62 via pins 1302 through strut mounting holes 1204. In particular embodiments, pins 1302 may be secured with cotter pins. In other embodiments, one or more of strut mounting holes 1204 or pin 1302 may be threaded. In particular embodiments, pin 1302 may comprise a threaded bolt, or any other suitable mechanism for coupling door strut 68 to operating beam 62 via strut mounting holes 1204.

Particular embodiments include bushing 1304. Bushing 1304 may be disposed on each side of pin 1302 between door strut 68 and angled flange 1202. Bushing 1304 may comprise a rubber compound or any other suitable bushing material. A particular advantage of bushing 1304 is that it reduces or prevents wear and galling between one or more of door strut 68, pin 1302, and angled flange 1202.

Figure 14:
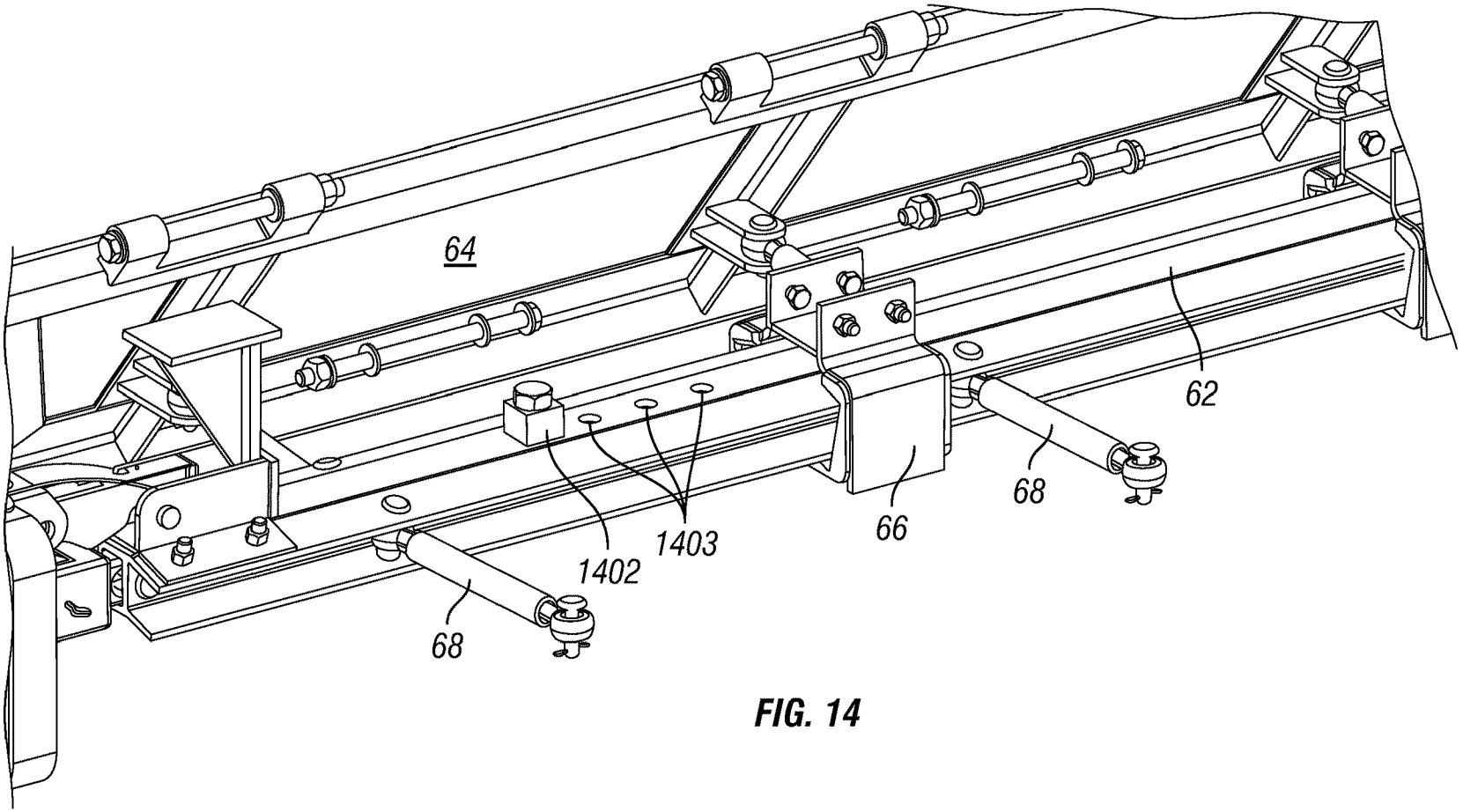
FIG. 14 is a schematic drawing showing a perspective view of an operating beam and a flow metering pin of an example hopper car, according to a particular embodiment.

FIG. 14 is a schematic drawing showing a perspective view of an operating beam and a flow metering pin of an example hopper car, according to a particular embodiment. Operating beam 62 includes adjustment holes 1403. Metering pin 1402 may be inserted in one of adjustment holes 1403 to limit the travel of operating beam 62, which controls how wide discharge doors 64 may open.

For example, in the illustrated embodiment as operating beam 62 is pushed from left to right, metering pin 1402 may contact guide 66, preventing operating beam 62 from moving any further. Changing the location of metering pin 1402 in the various adjustment holes 1403 adjusts the length of travel for operating beam 62.

In particular embodiments, metering pin 1402 may be secured with cotter pins. In other embodiments, one or more of adjustment holes 1403 or metering pin 1402 may be threaded. In particular embodiments, metering pin 1402 may comprise a threaded bolt, or any other suitable mechanism for retaining metering pin 1402 in adjustment holes 1403.

During unloading, if the lading is unloading faster or slower than the takeaway system is equipped to handle, a rail yard operator may close the longitudinal doors, adjust the metering pin to adjust the flow rate of the lading discharge, and reopen the discharge doors to discharge the lading at the adjusted rate. Matching the discharge rate to the capacity of the takeaway system results in a more efficient unloading, thus providing cost savings.

In particular embodiments, the discharge flow rate for multiple hoppers may be adjusted independently. For example, the flow rate of each hopper 22 of hopper car 20 may be adjusted independently (e.g., one hopper may adjusted to discharge faster or slower than the other) to fine tune the overall discharge rate of hopper car 20.

In particular embodiments, metering pin 1402 and adjustment holes 1403 provide a directional benefit. For example, adjusting discharge doors 64 to open a minimal amount may restrict the lading discharge to a narrow strip underneath the center of hopper car 20. Adjusting discharge doors 64 to open wider may result in a wider discharge pattern. The direction of the discharge may be adjusted to match the takeaway system (e.g., match the width of a takeaway conveyer, etc.).

Figure 15:
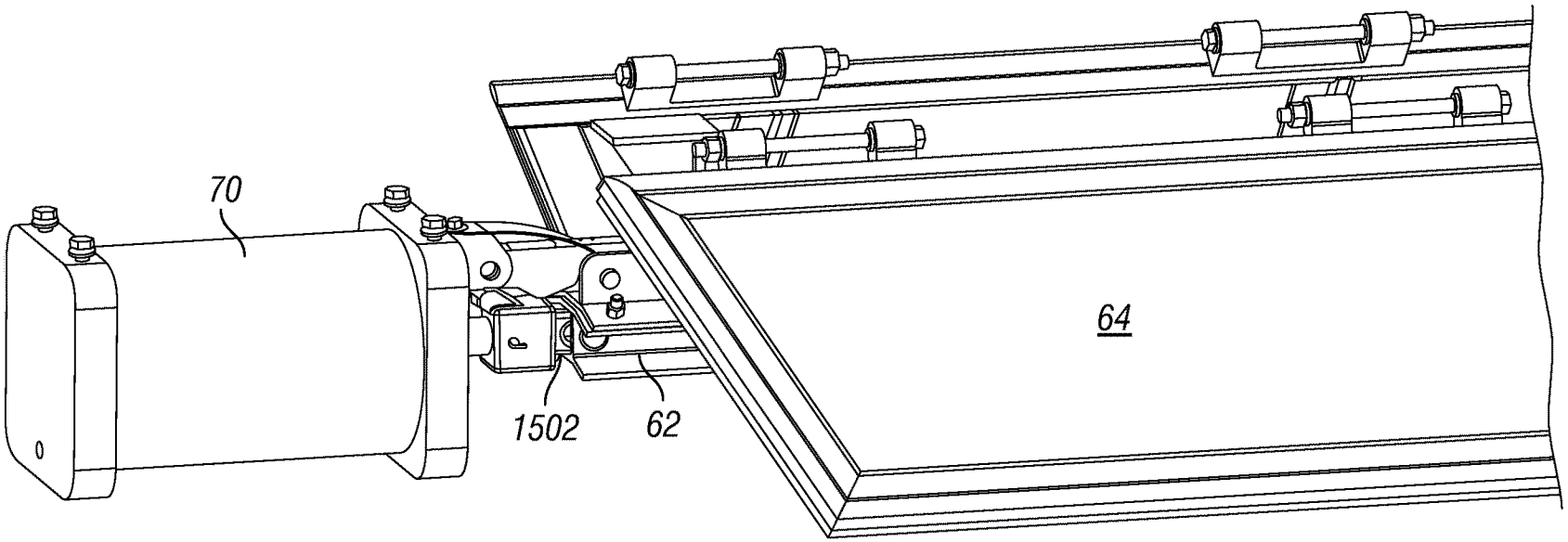
FIG. 15 is a schematic drawing showing a perspective view of an operating beam and a pin connecting the operating beam to a door actuating cylinder of an example hopper car, according to a particular embodiment.

FIG. 15 is a schematic drawing showing a perspective view of an operating beam and a pin connecting the operating beam to a door actuating cylinder of an example hopper car, according to a particular embodiment. Coupling pin 1502 couples operating beam 62 to operating cylinder 70. As illustrated in FIG. 12, in particular embodiments a portion of operating beam 62 may include a rectangular section. In particular embodiments, the rectangular portion of operating beam 62 may be extruded or pultruded to mate with an output coupling of operating cylinder 70. In particular embodiments, the portion of operating beam 62 may comprise any shape suitable for mating with operating cylinder 70.

For example, the rectangular portion of operating beam 62 may be extruded to a dimension just larger than an output coupler of operating cylinder 70 such that the output coupler of operating cylinder 70 may be inserted into the rectangular portion of operating beam 62. Simply drilling a hole in the end of operating beam 62 and inserting coupling pin 1502 through the hole and into the output coupler of operating cylinder 70 provides an efficient fabrication for coupling operating beam 62 to operating cylinder 70.

Figure 16:
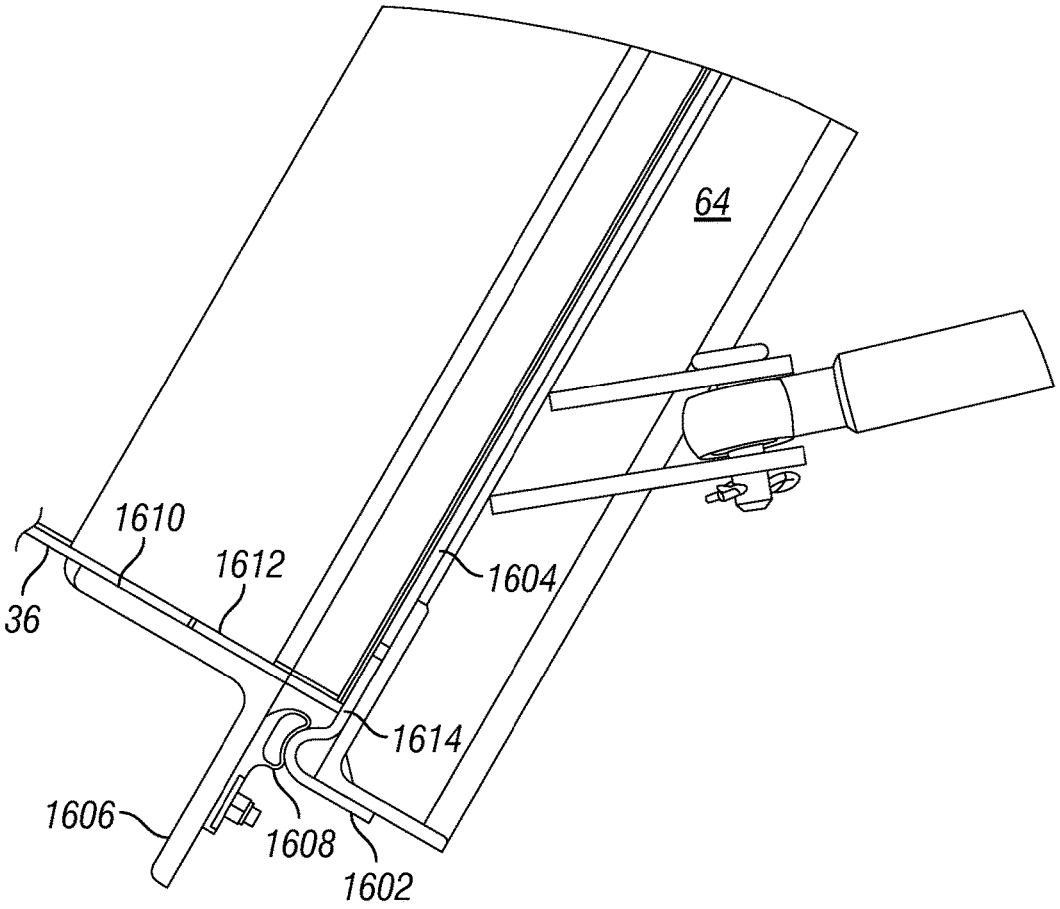
FIG. 16 is a schematic drawing showing a section view of a seal between a longitudinal discharge door and a hopper of an example hopper car, according to a particular embodiment.

FIG. 16 is a schematic drawing showing a section view of a seal between a longitudinal discharge door and a hopper of an example hopper car, according to a particular embodiment. Particular components of the seal are operable to prevent leakage of the lading material and prevent water seepage into the hopper. Other components are operable to reduce or prevent wear of the components that may come into contact when the discharge door is closed.

Discharge door 64 includes door lip 1602 and door lining 1604. Slope sheet 36 (also referred to as sloped side sheet 36) includes flange 1606, gasket 1608, first hopper lining 1610 and second hopper lining 1612. Discharge door 64 contacts slope sheet 36 at contact point 1614.

Door lip 1602 is a strip of material that abuts slope sheet 36 when discharge door 64 is closed. Door lip 1602 prevents a gap between discharge door 64 and the longitudinal opening of hopper 22 at contact point 1614. As illustrated, door lip 1602 comprises a formed arcuate shape. In other embodiments, door lip 1602 may comprise any suitable shape for mating with gasket 1608. In particular embodiments, door lip 1602 may comprise stainless steel. In other embodiments, door lip 1602 may comprise any material suitable for the lading of hopper 22.

For example, discharge door 64 may include door lining 1604 adapted for a particular commodity. In conventional hopper cars, repeated contact between the discharge door and the slope sheet as a result of opening and closing the discharge doors can cause the door lining to chip. A chipped lining may lead to corrosion of the metal underneath. In particular embodiments, door lining 1604 may stop short of contact point 1614. Door lip 1602 may comprise a material more durable than door lining 1604. In particular embodiments, door lip 1602 may comprise a non-corrosive material (e.g., stainless steel). When closing discharge doors 64, door lip 1602 (not door lining 1604) contacts slope sheet 36 at contact point 1614. Thus, a particular advantage of door lip 1602 is avoiding the chipping and corrosion problems found with conventional hopper cars.

In particular embodiments, the interior of hopper 22 may include first hopper lining 1610 and second hopper lining 1612. First hopper lining 1610 may be adapted for a particular lading commodity. Second hopper lining 1612 may comprise a durable or non-corrosive material (e.g., stainless steel). In particular embodiments, first hopper lining 1610 stops short of contact point 1614. Second hopper lining 1612 extends to contact point 1614 and comes in contact with door lip 1602. Thus, at contact point 1614, any contact is between two durable and/or non-corrosive materials, which prevents chipping and prevents corrosion if water does penetrate contact point 1614.

Flange 1606 is located outside of the portion of hopper 22 that contains the lading commodity (e.g., flange 1606 is coupled to an exterior portion of sloped sheet 36). Flange 1606 provides an attachment point for gasket 1608.

Gasket 1608 comprises a strip of flexible material (e.g., rubber, polymer, temperature-resistant material, flexible metal, etc.) attached to flange 1606. In particular embodiments, gasket 1608 compresses when contacted by a portion of discharge door 64, such as door lip 1602. The seal between gasket 1608 and discharge door 64 may prevent moisture from entering hopper 22. The seal may also prevent fine lading material from leaking out of hopper 22.

As illustrated, gasket 1608 is coupled to flange 1606 outside of the portion of hopper 22 that contains the lading commodity and is disposed in relation to contact point 1614 such that lading discharged from hopper 22 will not come into contact with gasket 1608. A particular advantage of this configuration is that it protects gasket 1608 from wear. It also prevents gasket 1608 from contacting and possibly contaminating the lading. In particular embodiments, gasket 1608 may be coupled to flange 1606 by a variety of fasteners, such as hook and loop fasteners, bolts, etc. In particular embodiments, gasket 1608 is removable and replaceable.

Gasket 1608 and door lip 1602 may be referred to as a double seal. Particular embodiments may use one of gasket 1608, door lip 1602, or a combination of both.

Figure 17:
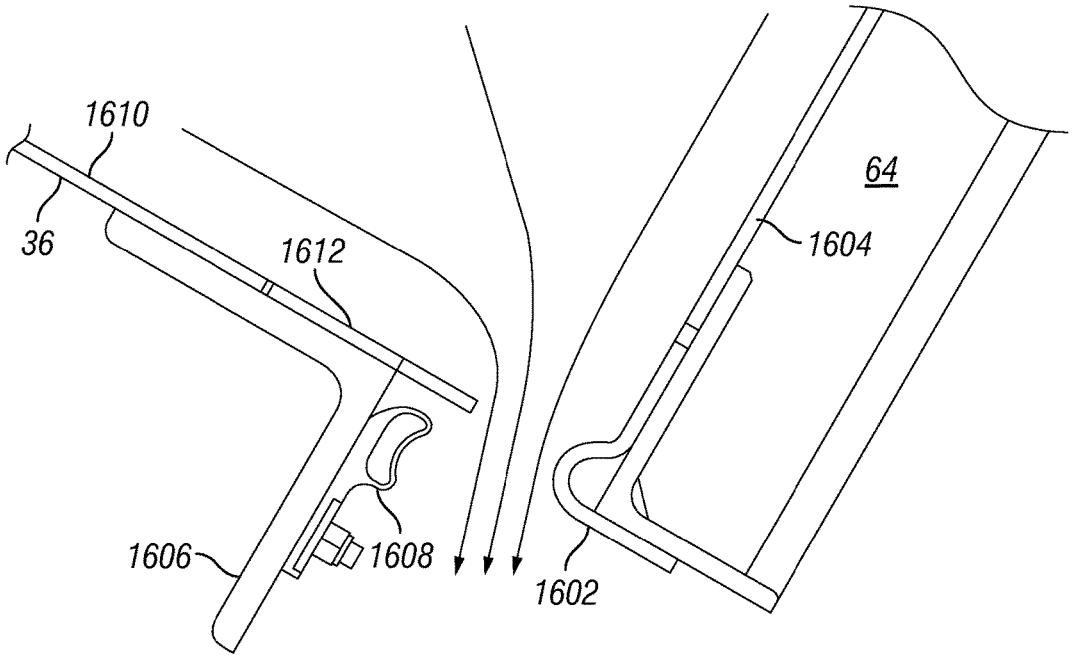
FIG. 17 is a schematic drawing showing a section view of a seal between a longitudinal discharge door and a hopper in an open position, according to a particular embodiment.

FIG. 17 is a schematic drawing showing a section view of a seal between a longitudinal discharge door and a hopper in an open position, according to a particular embodiment. The components of FIG. 17 are similar to like numbered components of FIG. 16.

As referred to with respect to FIG. 16 and illustrated in FIG. 17, gasket 1608 is coupled to flange 1606 outside of the portion of hopper 22 that contains the lading commodity and is disposed in relation to contact point 1614 such that lading discharged from hopper 22 (i.e., the arrows in the illustrated example) will not come into contact with gasket 1608. In other words, gasket 1608 coupled to slope sheet 36 is set back from the discharge end of slope sheet 36 so that gasket 1608 is out of a discharge path of the lading during the discharge of the lading from hopper 22. A particular advantage of this configuration is that it protects gasket 1608 from wear. It also prevents gasket 1608 from contacting and possibly contaminating the lading.

Referring back to FIG. 16, discharge door 64 comprises a first end (not illustrated) pivotally coupled to railcar 20 and operable to pivot discharge door 64 between a closed position that restricts a discharge of lading from hopper 22 and an open position (as illustrated in FIG. 17) that facilitates the discharge of lading from hopper 22. The discharge of lading is illustrated by the arrows flowing out of hopper 22.

Discharge door 64 comprises a second end, opposite the first end. The second end includes door lip 1602. The end of slope sheet 36 where the lading discharges (i.e., the end of slope sheet 36 at contact point 1614) may be referred to as the discharge end of slope sheet 36. The second end of discharge door 64 extends beyond the discharge end of slope sheet 36 when discharge door 64 is in the closed position. Door lip 1602 extends generally perpendicular to discharge door 64 (as illustrated) and parallel to slope sheet 36 when discharge door 64 is in the closed position.

In particular embodiments, door lip 1602, flange 1606, and/or gasket 1608 may be coupled to railcar 20 during manufacturing of railcar 20. In some embodiments, door lip 1602, flange 1606, and/or gasket 1608 may be retrofitted to an existing railcar 20. An example is illustrated in FIG. 18.

Figure 18:
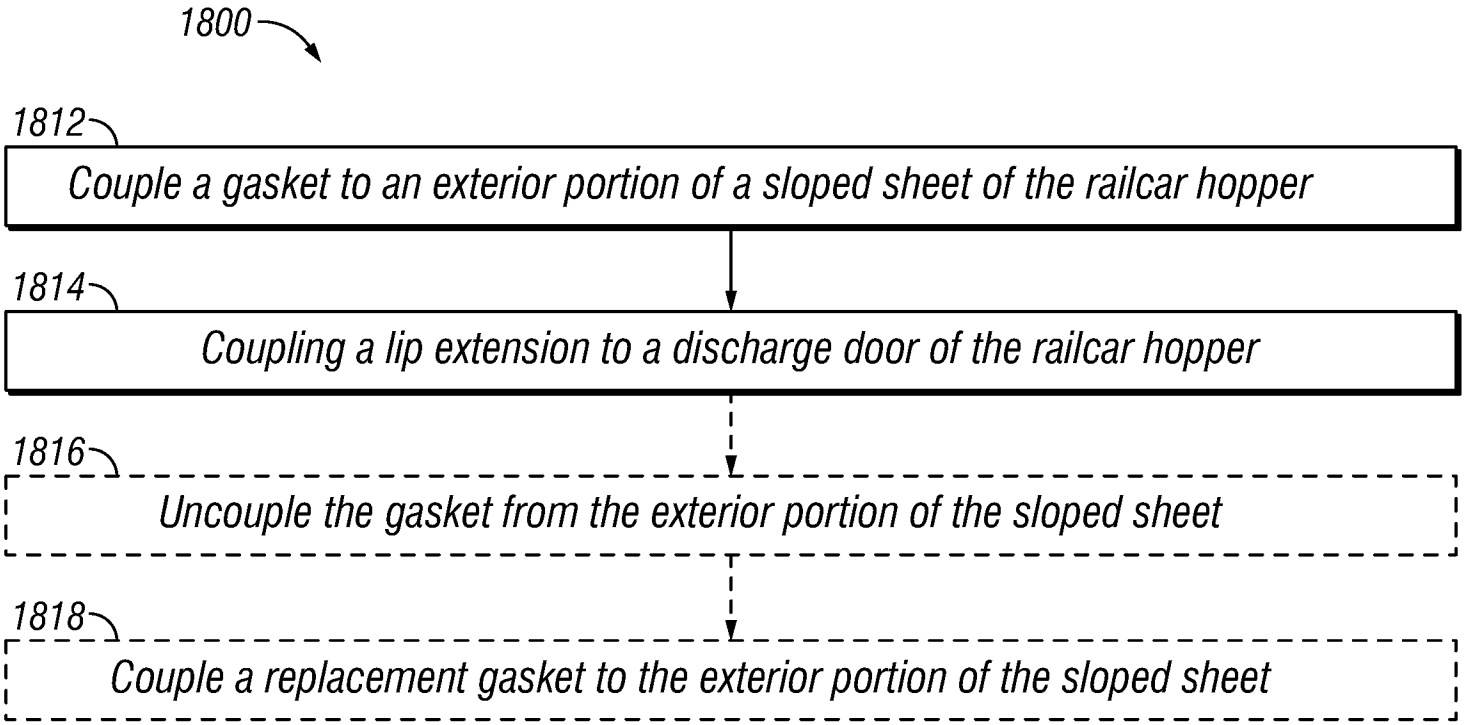
FIG. 18 is a flow diagram illustrating an example method of outfitting a railcar hopper with a discharge gate seal, according to some embodiments.

FIG. 18 is a flow diagram illustrating an example method of outfitting a railcar hopper with a discharge gate seal, according to some embodiments. In particular embodiments, one or more steps of FIG. 10 may be performed to install a discharge gate seal, such as door lip 1602 and gasket 1608, on a railcar, such as railcar 20, described with respect to FIGS. 1-17.

The method begins at step 1812, where a gasket is coupled to an exterior portion of a sloped sheet of a railcar hopper. For example gasket 1608 may be coupled to an exterior portion of slope sheet 36 of hopper 22. In particular embodiments, gasket 1608 may be coupled via flange 1606. Hopper 22 may comprise a hopper of a new railcar 20 or an existing railcar 20.

At step 1816, a lip extension is coupled to a discharge door of the railcar hopper. The lip extension extends beyond a discharge end of the sloped sheet when the discharge door is in the closed position. The lip of the lip extension extends generally perpendicular to the discharge door and parallel to the sloped sheet when the discharge door is in the closed position. The lip of the lip extension contacts the gasket coupled to the exterior portion of the sloped sheet when the discharge door is in the closed position.

For example, door lip 1602 may be coupled to discharge door 64. For new construction, discharge door 64 may extend beyond the discharge end of slope sheet 36 when discharge door 64 is closed. Door lip 1602 may be coupled to the second end of discharge door 64.

For a retrofit application, discharge door 64 may not extend beyond the discharge end of slope sheet 36 when discharge door 64 is closed. Door lip 1602 may comprise a door lip extension coupled to the second end of discharge door 64 such that the lip of the door lip extension extends beyond the discharge end of slope sheet 36 when discharge door 64 is closed.

In particular embodiments, coupling door lip to the discharge door may comprise removing a portion of the door lining (e.g., such as door lining 1604) and replacing it with door lip 1602.

In some embodiments, the gasket may be removable to facilitate replacement of worn parts. Particular embodiments may include gasket replacement steps 1816 and 1818.

At step 1816, the gasket is uncoupled from the exterior portion of the sloped sheet. For example, gasket 1608 may be uncoupled (e.g., unbolted, separated hook and loop fastener, etc.) from flange 1606.

At step 1818, a replacement gasket is coupled to the exterior portion of the sloped sheet. For example a replacement gasket 1608 is coupled to flange 1606.

Modifications, additions, or omissions may be made to method 1000. Additionally, one or more steps in method 1000 of FIG. 10 may be performed in parallel or in any suitable order. For example, steps 1816 and 1818 may be omitted, and/or steps 1812 and 1814 may be performed in reverse order or in parallel with each other.

Although the components in FIGS. 16-18 are described with respect to longitudinal doors, particular embodiments may include transverse doors, or any other suitable discharge door of a railcar.

Although particular embodiments and their advantages have been described in detail, it should be understood that various changes, substitutions and alternations can be made herein without departing from the spirit and scope of the embodiments.

The invention claimed is:

1. A railcar comprising:

an underframe, a pair of sidewall assemblies, and at least one hopper formed between the sidewall assemblies;

the at least one hopper comprising a sloped sheet and a discharge door;

the discharge door comprising a first end and a second end opposite the first end, the first end of the discharge door pivotally coupled to the railcar and operable to pivot the discharge door between a closed position that restricts a discharge of lading from the at least one hopper and an open position that facilitates the discharge of lading from the at least one hopper;

the sloped sheet comprising:

a discharge end, wherein an edge of the discharge end in contact with the discharge door at a first contact point when the discharge door is in the closed position; and a gasket coupled to an exterior portion of the sloped sheet;

the second end of the discharge door extending beyond the discharge end of the sloped sheet when the discharge door is in the closed position;

the discharge door further comprising a lip disposed at the second end of the discharge door extending generally perpendicular to the discharge door and parallel to the sloped sheet when the discharge door is in the closed position; and the lip of the discharge door contacting the gasket of the sloped sheet at a second contact point when the discharge door is in the closed position.

2. The railcar of claim 1, wherein the gasket coupled to the sloped sheet is set back from the discharge end of the sloped sheet so that the gasket is out of a discharge path of the lading during the discharge of the lading from the at least one hopper.

3. The railcar of claim 1, wherein the discharge door comprises a longitudinal discharge door.

4. The railcar of claim 1, wherein the discharge door comprises a transverse discharge door.

5. The railcar of claim 1, wherein a portion of the discharge door facing the interior of the at least one hopper is lined with a first material and the lip of the discharge door comprises a second material different from the first material.

6. The railcar of claim 1, wherein an interior portion of the sloped sheet is lined with a first material and the discharge end of the sloped sheet is lined with a second material different from the first material.

7. The railcar of claim 1, wherein the lip of the discharge door comprises stainless steel.

8. The railcar of claim 1, wherein the lip of the discharge door comprises a formed arcuate shape.

9. The railcar of claim 1, wherein the gasket is removably coupled to the sloped sheet.

10. A discharge apparatus for a railcar hopper, the discharge apparatus comprising:

a gasket coupled to an exterior portion of a sloped sheet of the railcar hopper;

a discharge door comprising:

a first end and a second end, the first end of the discharge door operable to pivot the discharge door between a closed position that restricts a discharge of lading from the railcar hopper and an open position that facilitates the discharge of lading from the railcar hopper;

a lip disposed at the second end of the discharge door extending generally perpendicular to the discharge door and parallel to the sloped sheet when the discharge door is in the closed position;

wherein:

the sloped sheet comprises a discharge end and an edge of the discharge end is in contact with the discharge door at a first contact point when the discharge door is in the closed position;

the second end of the discharge door extends beyond a discharge end of the sloped sheet when the discharge door is in the closed position; and the lip of the discharge door contacting the gasket coupled to the exterior portion of the sloped sheet at a second contact point when the discharge door is in the closed position.

11. The discharge apparatus of claim 10, wherein the gasket coupled to the exterior portion of the sloped sheet is set back from the discharge end of the sloped sheet so that the gasket is out of a discharge path of the lading during the discharge of the lading from the at least one hopper.

12. The discharge apparatus of claim 10, wherein the discharge door comprises a longitudinal discharge door.

13. The discharge apparatus of claim 10, wherein the discharge door comprises a transverse discharge door.

14. The discharge apparatus of claim 10, wherein a portion of the discharge door facing the interior of the at least one hopper is lined with a first material and the lip comprises a second material different from the first material.

15. The discharge apparatus of claim 10, wherein an interior portion of the sloped sheet is lined with a first material and the discharge end of the sloped sheet is lined with a second material different from the first material.

16. The discharge apparatus of claim 10, wherein the lip of the discharge door comprises stainless steel.

17. The discharge apparatus of claim 10, wherein the lip of the discharge door comprises a formed arcuate shape.

18. The discharge apparatus of claim 10, wherein the gasket is removably coupled to the sloped sheet.

19. A method of outfitting a railcar hopper with a discharge gate seal, the method comprising:

coupling a gasket to an exterior portion of a sloped sheet of the railcar hopper;

coupling a lip extension to a discharge door of the railcar hopper, the lip extension extending beyond a discharge end of the sloped sheet when the discharge door is in the closed position, a lip of the lip extension extending generally perpendicular to the discharge door and parallel to the sloped sheet when the discharge door is in the closed position; and wherein:

the sloped sheet comprises a discharge end and an edge of the discharge end is in contact with the discharge door at a first contact point when the discharge door is in the closed position;

the lip of the lip extension contacts the gasket coupled to the exterior portion of the sloped sheet at a second contact point when the discharge door is in the closed position.

20. The method of claim 19, further comprising:

uncoupling the gasket from the exterior portion of the sloped sheet; and coupling a replacement gasket to the exterior portion of the sloped sheet.

* * * * *